US005573301A

United States Patent [19]

Scott

[11] Patent Number: 5,573,301

[45] Date of Patent: Nov. 12, 1996

[54] TABLE FOR CHAIR

[75] Inventor: Donald G. Scott, Tupelo, Miss.

[73] Assignee: Charles S. Fox, Tupelo, Miss.

[21] Appl. No.: 434,576

[22] Filed: May 16, 1995

[51] Int. Cl.[6] ..... A47B 39/00

[52] U.S. Cl. ..... 297/173; 297/170; 297/463.1

[58] Field of Search ..... 297/173, 463.1, 297/135, 170, 171, 174, 147, 188.15, 188.21, 188.01, 188.05; 108/50

[56] References Cited

U.S. PATENT DOCUMENTS

| | | | |
|---|---|---|---|
| 564,044 | 7/1896 | Berkemeyer | 297/170 |
| 818,917 | 4/1906 | Ruger | 297/173 |
| 975,755 | 11/1910 | Eyles . | |
| 1,659,572 | 2/1928 | Klemm | 297/171 X |
| 2,503,543 | 4/1950 | Caston | 155/128 |
| 2,518,381 | 8/1950 | Runkles | 155/188 |
| 2,640,597 | 6/1953 | Thomson | 297/135 X |
| 2,746,526 | 5/1956 | Loeschnigg et al. | 155/127 |
| 4,455,008 | 6/1984 | MacKew | 248/447.2 |
| 4,500,134 | 2/1985 | Kaneko et al. | 297/173 X |
| 5,050,929 | 9/1991 | Gueringer et al. | 297/145 |
| 5,217,277 | 6/1993 | Rasnick et al. | 297/145 |
| 5,294,177 | 3/1994 | Rasnick et al. | 297/270 |

FOREIGN PATENT DOCUMENTS

| | | | |
|---|---|---|---|
| 292824 | 6/1928 | United Kingdom | 297/173 |

*Primary Examiner*—Milton Nelson, Jr.
*Attorney, Agent, or Firm*—Walker, McKenzie & Walker, P.C.

[57] ABSTRACT

The present device is an improved table for attachment to the frame of a chair. The improved table comprises, in general, a table top including a first table top half and a second table top half; cooperative holding devices for holding the table halves together to establish a unitary condition of the table top; a first crank for rotatably supporting the first table top half for rotation about a first substantially vertical axis; a first mounting tube for rotatably supporting the first crank for rotation about a second substantially vertical axis offset from the first vertical axis, a first bracket for attaching the first mounting tube to the frame of the chair; a second crank for rotatably supporting the second table top half for rotation about a third substantially vertical axis; a second mounting tube for rotatably supporting the second crank for rotation about a fourth substantially vertical axis offset horizontally from the third vertical axis, and a second bracket for attaching the second mounting tube to the frame of the chair. The dimensions of the components of the table and the distances between certain pivot axes can be selected so that parallel movement of the table top can be accomplished. However, if the dimensions of the chair are such that will not permit the above mentioned dimensions to be selected, under certain conditions the table top may be moved from a forward most position to a rearward most parallel position by skewing the table top as it is moved.

8 Claims, 2 Drawing Sheets

TABLE FOR CHAIR

BACKGROUND OF THE INVENTION

1. Field of the Invention

The present invention relates, in general, to a table for a chair, and in particular, to a table for any type of upholstered chair having wide arms.

2. Information Disclosure Statement

It is often desired to have a table for attachment to a chair that will fit various sizes of chairs and can be adjusted to various positions relative to the person sitting in the chair. Also, it is desired to have such a table that allows for easy access for the person to be seated in the chair and/or getting up from the chair. Known attempted solutions for these problems include table halves that are respectively hingedly mounted on the chair arms and that flip inwardly towards one another. Other attempted solutions have table halves that are respectively pivoted about single pivot axes, while still others slide into place.

A preliminary patentability search in Class 297, subclasses 145,188.14, 188.15,188.16, 188.17, 188.18, and 188.19, produced the following patents, some of which may be relevant to the present invention: Eyles, U.S. Pat. No. 975,755, issued Nov. 15, 1910; Caston, U.S. Pat. No. 2,503,543, issued Apr. 11, 1950; Runkles, U.S. Pat. No. 2,518,381, issued Aug. 8, 1950; Loeschnigg et al., U.S. Pat. No. 2,746,526, issued May 22, 1956; MacKew, U.S. Pat. No. 4,455,008; issued Jun. 19, 1984; Gueringer et al., U.S. Pat. No. 5,050,929, issued Sep. 24, 1991; Rasnick et al., U.S. Pat. No. 5,217,277, issued Jun. 8, 1993; and Rasnick et al., U.S. Pat. No. 5,294,177, issued Mar. 15, 1994. None of the above identified patents disclose or suggest the present invention.

SUMMARY OF THE INVENTION

The present invention is an improved table for attachment to the frame of a chair. The improved table comprises, in general, a table top including a first table top half and a second table top half; holding means for aligning and holding the table top halves together to establish a unitary condition of the table top; a first crank for rotatably supporting the first table top half for rotation about a first substantially vertical axis; first mounting means for mounting the first table top half from a portion of the chair frame; first attachment means for attaching the first mounting means to the frame of the chair and for rotatably supporting the first crank means for rotation about a second substantially vertical axis offset horizontally from the first vertical axis; and second mounting means, substantially identical to the first mounting means, mounting the second table top half from the frame. It should be understood that when the term "table top half" or "table top halves" are used herein it is to be taken, not necessarily to mean portions of the table top that are exact "halves" of the table top, but rather any relative sizes of the two portions of the table top. For example, one table top half may be one fourth of the overall length of the table top and the other table top half may be three fourths of the overall length of the table top. In other words the terms "table top half" or "table top halves" refer respectively to the portion or portions of the table top rather than to particular relative sizes of the table top halves.

It is an object of the present invention to provide an efficient, unique, and improved means for adjusting a table into a selected forward or rearward position on a chair, which adjusting means includes a pair of cranks that permit a double rotational action of the opposite ends of the held and unitized table top halves when the table top is moved between the forward and rearward positions.

It is a further object to provide such a table which allows for variations in frame sizes of the chairs so that one table size will fit various sizes of chairs and manufacturing tolerances need not be so close as was heretofore necessary.

A still further object is to provide such a table in which the table halves are easy to align when bringing the halves together for holding.

DESCRIPTION OF THE PREFERRED EMBODIMENT

Figure 1:
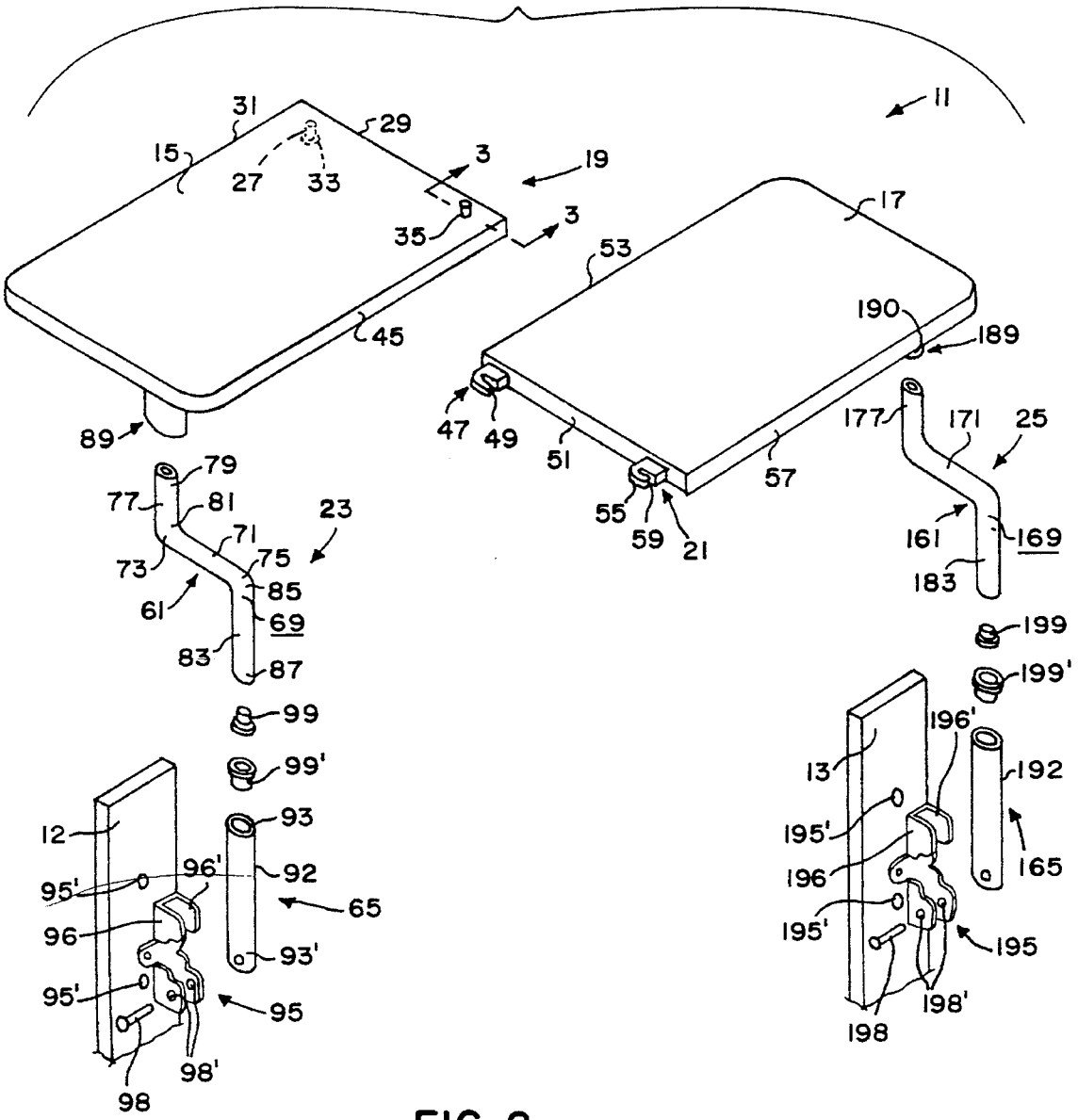
FIG. 1 is an exploded view of the table of the present invention.

Referring now to the drawings, table 11 of the present invention is for attachment to a chair, not shown, having frame portions 12 and 13. Table 11 comprises, in general, a table top 14 including a first table top half 15 and a second table top half 17; first holding means 19 on first table top half 15 and second holding means 21 on second table top half 17 for aligning and detachably holding first table top half 15 and second table top half 17 together to establish a unitary condition of table top 14; first mounting means 23 for mounting first table top half 15 from frame portion 12, and second mounting means 25 for mounting second table top half 17 from frame portion 13.

More particularly, first holding means 19 includes an alignment stud 27 that is attached to the bottom of first table top half 15, preferably adjacent the corner of the first table top half 15 that is adjacent the inner edge 29 and the forward edge 31 of first table top half 15. Stud 27 depends from the bottom of first table top half 15 and preferably has a head 33 at the lower end thereof. First holding means 19 also includes a pin 35 adjacent the corner of first table top half that is adjacent the inner edge 29 and rearward edge 45 of first table top half 15. Pin 35 slidably extends through an opening 37 provided through first table top half 15 and is urged upwardly by a compression spring 39 that extends between the upper surface of first table top half 15 and a head 41 provided on the upper end of pin 35. The lower end of pin 35 is also provided with a head 43 that limits upward movement of pin 35 into a first position.

Second holding means 21 includes a receiver 47 fixedly attached to the inner edge 51 of second table top half 17 adjacent the corner of second table top half 17 that is adjacent forward edge 53 of second table top half 17. Receiver 47 has a rearwardly facing slot 49 therein that is adapted to receive stud 33 for aiding in the alignment of the table top halves 15, 17, as will be better understood in the description of the use of table 11 to follow later in the specification. Second holding means 21 also includes a receiver 55 fixedly attached to the inner edge 51 of second table top half 17 adjacent the corner of second table top half 17 that is adjacent rearward edge 57 of table top half 17. Receiver 55 has a rearwardly facing key-hole type slot 59 therein which is adapted to receive pin 35 and hold the table top halves 15 and 17 together when pin 35 is first moved downwardly and then released when stud 27 is in slot 49. When the table top halves 15, 17 are held together, a unitary condition of table 11 is established with the table top halves 15, 17 having the inner edges 29, 51 thereof in substantial abutment with one another and with the table top halves 15, 17 being in transverse alignment as best seen in FIGS. 4*a*–4*e*.

It will be understood that first and second holding means 19, 21 may be provided in other forms which align and detachably hold the table top halves 15, 17 together to establish the unitary condition of table 11, without departing from the spirit and scope of the present invention.

First mounting means 23 includes, in general, first crank means 61 for rotatably supporting first table top half 15 for rotation about a first substantially vertical axis 63. First mounting means 23 additionally includes first attachment means 65 for attaching first mounting means 23 to first frame portion 12 and for rotatably supporting first crank means 61 about a second substantially vertical axis 67 offset from first vertical axis 63.

More specifically, first crank means 61 comprises a first crank 69 that includes a horizontally extending portion 71 having a first end 73 and a second end 75, an upper arm 77 having an upper end 79 and a lower end 81. The lower end 81 of the upper arm 77 is integrally attached to first end 73 of horizontally extending portion 71 with upper arm 77 upstanding from horizontally extending portion 71. First crank 69 includes a lower arm 83 having an upper end 85 and a lower end 87. The upper end 85 of lower arm 83 is integrally attached to the second end 75 of horizontally extending portion 71 with lower arm 83 depending vertically downwardly from horizontally extending portion 71 and with lower arm 83 being parallel with upper arm 77. In addition, first crank means 61 comprises first socket means 89 attached to first table top half 15 removably receiving upper end 79 of upper arm 77 for rotation of first table top half 15 about upper arm 77 of first crank 69, i.e. about first vertical axis 63. First socket means 89 preferably comprises a first cylindrical tube 90 having a first socket 91 into which upper end 79 of upper arm 77 removably extends.

Figure 2:
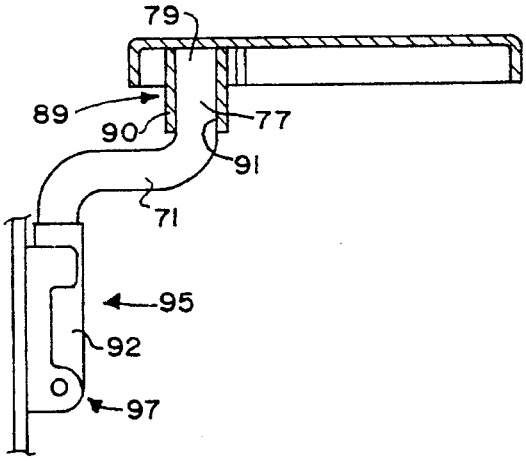
FIG. 2 is a partially sectionalized side elevational view of one half of the table of the present invention.
Figure 3:
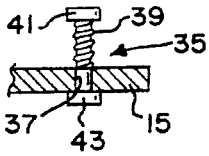
FIG. 3 is an enlarged sectional view taken as on the line 3—3 of FIG. 1.

First attachment means 65 comprises a first mounting tube 92 having an upper end 93 and a lower end 93'. First mounting tube 92 rotatably receives the lower arm 83 of first crank 69 for rotation of first crank 69 relative to first mounting tube 92, i.e. about second vertical axis 67 when mounting tube 92 is in a normal "in" use vertical position as shown in FIG. 2. Second vertical axis 67 is offset horizontally from first vertical axis 63 when mounting tube 92 is in the "in use" vertical position. First attachment means 65 also comprises a first bracket means 95 for attachment to first frame portion 12 by suitable means well known to those skilled in the art, such as screws or the like extending through holes 95' in frame portion 12. First bracket means 95 includes first tabs 96, 96', spaced horizontally apart for removably receiving first mounting tube 92 therebetween to selectively hold first mounting tube 92 in a vertical position or in a horizontal position for storage. First tabs 96, 96' are made of suitable springy material that will allow the tabs to be forced apart for the entry and exiting of first mounting tube 92 and yet will selectively hold mounting tube 92 in an upright position when desired. In addition, first attachment means 65 comprises first pivot means 97 for pivotally mounting first mounting tube 92 on the first bracket means 95. First pivot means 97 includes a pin 98 extending through aligned holes 98' in first bracket means 95 and in the lower end 93' of first mounting tube 92. Preferably, although not necessarily, suitable bushings well known to those skilled in the art, as for example, bushings 99, 99', are provided between lower arm 83 and first mounting tube 92.

Referring now to second mounting means 25, the second mounting means 25 is substantially identical to the first mounting means 23. Consequently, the parts of second mounting means 25 are substantially identical with the corresponding parts of first mounting means 23 and are respectively designated by the same numbers as used for first mounting means 23 preceded by the numeral 1. Thus, for example, second crank means 161, second attachment means 165, second crank 169, horizontally extending portion 171 of second crank 169, upper arm 177 of second crank 169, lower arm 183 of second crank 169, second socket means 189, second cylindrical tube 190, second socket (not shown), second mounting tube 192, second bracket means 195, spaced tabs 196, 196', of second bracket means 195, holes 195' pin 198, holes 198' in bracket means 195, and bushings 199, 199' respectively correspond to and are substantially identical in construction to first crank means 61, first attachment means 65, first crank 69, horizontally extending portion 71 of first crank 69, upper arm 77 of first crank 69, lower arm 83 of first crank 69, second socket means 89, first cylindrical tube 90, first socket 91, first mounting tube 92, first bracket means 95, spaced tabs 96, 96' of first bracket means 95, pin 98, holes 98' in bracket means 95, and bushings 99, 99'. In the operation of table 11 third axis 163 corresponds to first axis 63 and fourth axis 167 corresponds to second axis 67.

The table 11 of the present invention is adapted to be mounted in any type of upholstered chair having wide arms. As is well known to those skilled in the art, many of the upholstered chairs of the present day have wide arms that have cavities down inside the left and right arms of the chair for enclosing various devices such as radios, tables tops, etc. One such upholstered chair with a cavity in each of the arms and with hinged tops respectively provided over the cavities is shown in U.S. Pat. No. 5,050,929, issued Sep. 24, 1991 to Gueringer et al.

More specifically, the table 11 of the present invention is adapted to be mounted on the frame of a chair that includes first and second frame portions 12, 13, which frame portions are also known as front stumps and are well known to those skilled in the art. One of the frame portions 12, 13 is located in the cavity in the left hand arm of the chair, not shown, and the other frame portion is located in the cavity in the right hand arm of the chair. It will be understood that the frame portions 12, 13 are respectively at the front of the cavities, and for purposes of clarity of description the frame portion 12 (i.e., the first frame portion) will be considered to be in the cavity at the left hand arm of the chair and frame portion 13 (i.e., the second frame portion) will be considered to be in the cavity at the right hand arm of the chair, with the left and right hand designations being considered from the standpoint of a person sitting in the chair.

Figure 4A:
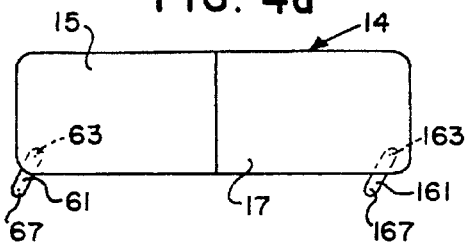
FIGS. 4*a*, 4*b*, 4*c*, 4*d*, and 4*e* are diagrammatic plan views of the table of the present invention showing the progressive movement of the table top from a forward position in FIG. 4*a* to a rearward position in FIG. 4*e* when the dimensions of the components of the table and the distances between certain pivot axes are such that will permit parallel movement of the table top.

In describing the operation of table 11, it is first assumed that the table is in a condition as shown in FIG. 4*a* with the table top halves 15, 17 held together and with the table top 14 in the forward position shown in FIG. 4*a*. Assuming further that a user desires to sit in the chair and use the table 11, the user will first detach the table top halves 15, 17 by depressing pin 35 so that table top halves 15, 17 may be released from one another, and so that the table top halves 15, 17 may be swung outwardly away from one another for the user to gain access therebetween in order to sit in the chair. Then, if the user desires to use the table top 14, as for example, to eat therefrom, the user follows the reverse procedure of that stated hereinabove again to align and hold the table top halves 15, 17 together to provide a unified condition of the table 11. Then, if the user desires to bring the table top 14 closer, the table top 14 is simply pulled (preferably as by grasping one or both of cranks 69, 169) by the user rearwardly towards himself or herself progressively as depicted by the sequential positions shown in FIGS. 4*b*, 4*c*, 4*d*, etc. until the desired position is reached. It will be understood that the second and fourth axes 67, 167 will remain stationary, cranks 61,161 will respectively rotate together counterclockwise about second and fourth axes 67, 167, and there will be relative rotation respectively between table top halves 15, 17 and cranks 61, 161. It is this double rotation or pivot that is one of the principal unique features about the present invention.

Figure 4B:
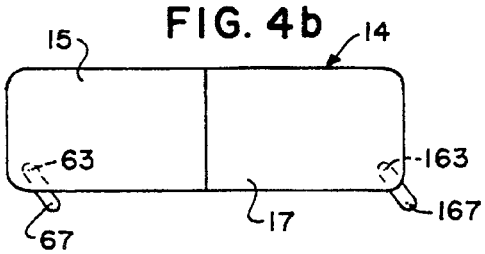
Figure 5B:
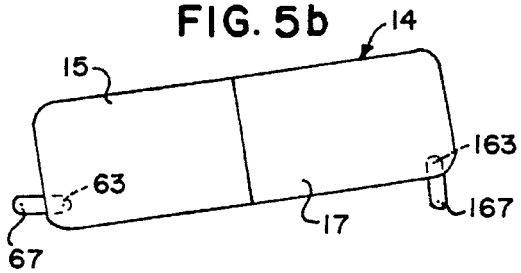
Figure 4C:
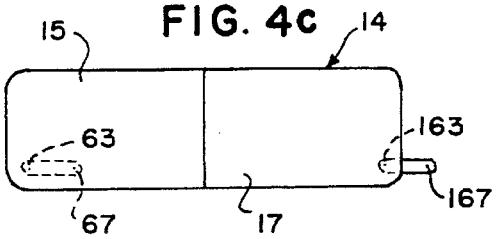
Figure 5C:
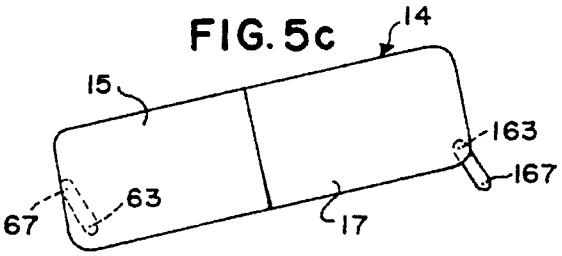
Figure 4D:
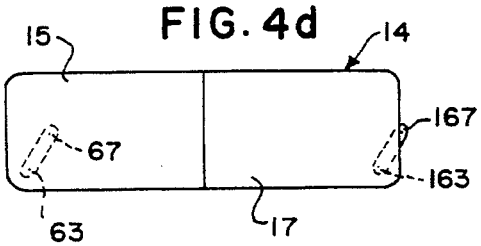
Figure 5D:
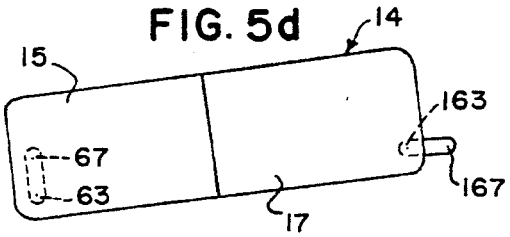

In the above described movement of the unified table top 14 from the forward position shown in FIG. 4*a* towards a rearward position into any of the positions illustrated in FIGS. 4*a*–4*b*, and in the opposite direction towards the forward position, the positions will always be parallel with one another and will be transverse relative to the chair, assuming, of course, that the distance between the second and fourth axes 67, 167 is the same as the distance between the first and third axes 67,167, and the distance between the first and second axes 63, 67 is the same as the distance between the third and fourth axes 163, 167.

Figure 5A:
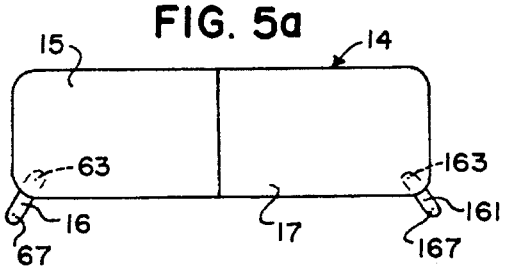
FIGS. 5*a*, 5*b*, 5*c*, 5*d*, and 5*e* are diagrammatic plan views of the table of the present invention showing the progressive movement of the table top from a forward most position in FIG. 5*a* to a rearward most position in FIG. 5*e* when the dimensions of the components of the table and the distances between certain pivot axes are such that will not permit parallel movement of the table top through the positions of the table top between the forward most position and the rearward most position.
Figure 5E:
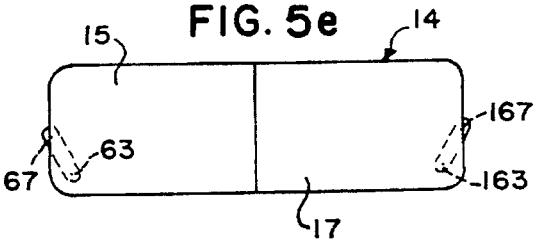

On the other hand, if the distances are not as set forth in the preceding paragraph, as for example, if they are like those in FIGS. 5*a*–5*e* in which the distance between second axis 67 and fourth axis 167 is greater than the distance between first axis 63 and third axis 163, the table 11 of the present invention will still be workable and may be movable forwardly and rearwardly between a forward most position shown in FIG. 5*a* (in which table top 14 is squared with the chair) and a rearward most position shown in FIG. 5*e* (in which table top 14 is parallel with the position shown in FIG. 5*a*), provided, of course, that certain parameters are not exceeded, as will be explained later in the specification. If said parameters are met, such a situation in which the table 11 will still be workable will occur, for example, when an installer of tables 11 (which have a constant dimension between first axis 63 and third axis 163), is confronted with a chair which has a greater width than average so that by necessity the distance between second axis 67 and fourth axis 167 in order to install the table 11 is greater than the distance between first axis 63 and third axis 163. Therefore, it will be seen that, with the present invention, a table 11 is provided which allows for variations in frame sizes of the chairs so that one table size will fit various sizes of chairs and so that manufacturing tolerances need not be so close as heretofore necessary. In the situation illustrated in FIGS. 5*a*–5*e*, it will be seen that in moving the table top between the forward most position shown in FIG. 5*a* and the rearward most position shown in FIG. 5*e* the table top 14 makes a motion which could be described as a "figure eight motion" or "skewing motion".

Figure 4E:
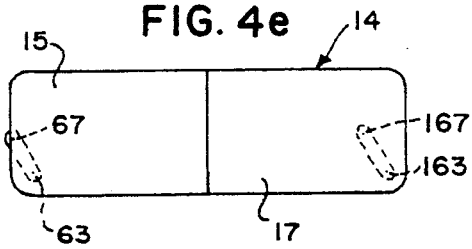

It should be pointed out that although FIGS. 4*a*–4*e* and FIGS. 5*a*–5*e* show the table top 14 respectively revolving or being skewed in One direction in going from the forward positions respectively shown in FIGS. 4*a* and 5*a* toward the rearward positions respectively shown in FIGS. 4*e* and 5*e*, it will be understood that the table top 14 may be moved from the forward positions of FIGS. 4*a* and 5*a* toward the rearward most position by revolving or skewing table top 14 in the opposite direction. Also, it should be pointed out that in going from the rearward positions toward the forward positions the reverse of the above described motions may be carried out, that is, respectively revolving or skewing table top 14 in either of the two directions heretofore described.

The heretofore mentioned parameters for the table 11 to be workable are expressed by the following formula: The distance between second axis 67 and fourth axis 167 must not be less than the distance found by subtracting the distance between first axis 63 and second axis 67 from the distance between first axis 63 and third axis 163. In the formula herein set forth in this paragraph, it is assumed that the cranks 69 and 169 have the same dimensions, i.e., the distance between first and second axes 63, 67 is the same as the distance between third and fourth axes 163, 167.

If the user does not want to use the table but desires to store same, the user separately pulls upwardly on the respective separated table top halves 15, 17, removes them from upper arms 77, 177 of first and second cranks 69,169, and stores the table top halves 15, 17 in the cavities in the arms of the chair. Then, the first and second mounting tubes 92, 192 with first and second cranks 69,169 attached thereto may respectively be pivoted downwardly into horizontal positions in the respective cavities. The reverse of the above storing procedure is carried out to again place the table top 14 in a usable condition.

Although the present invention has been described and illustrated with respect to a preferred embodiment and a preferred use therefor, it is not to be so limited since modifications and changes can be made therein which are within the full intended scope of the invention.

I claim:

1. In combination, a chair frame including a first frame portion and a second frame portion, and a table, said table comprising:

(a) a table top, said table top including a first table top half and a second table top half;

(b) first holding means on said first table top half and second holding means on said second table top half for detachably holding said first table top half and said second table top half together to establish a unitary condition of said table top;

(c) first mounting means mounting said first table top half from said first portion of said frame, said first mounting means comprising:

i. first crank means for rotatably supporting said first table top half for rotation about a first substantially vertical axis;

ii. first attachment means for attaching said first mounting means to said first portion of said frame and for rotatably supporting said first crank means for rotation about a second substantially vertical axis offset horizontally from said first vertical axis;

(d) second mounting means mounting said second table top half from said second portion of said frame, said second mounting means comprising:

i. second crank means for rotatably supporting said second table top half for rotation about a third substantially vertical axis;

ii. second attachment means for attaching said second mounting means to said second portion of said frame of said chair and for rotatably supporting said second crank means for rotation about a fourth axis horizontally offset from said third vertical axis.

2. The combination of claim 1 in which the distance between said first vertical axis and said third vertical axis is the same as the distance between said second vertical axis and said fourth vertical axis, and the distance between said first vertical axis and said second vertical axis is the same as the distance between said third vertical axis and said fourth vertical axis.

3. The combination of claim 1 in which the distance between said first vertical axis and said third vertical axis is not the same as the distance between said second vertical axis and said fourth vertical axis, and the distance between said first vertical axis and said second vertical axis is the same as the distance between said third vertical axis and said fourth vertical axis.

4. The combination of claim 1 in which the relative distances between said first vertical axis and said third vertical axis, between said second vertical axis and said fourth vertical axis, between said first vertical axis and said second vertical axis, and between said third vertical axis and said fourth vertical axis are such that said table top is movable between spaced apart forward and rearward positions which are parallel with one another.

5. The combination of claim 1 in which said first crank means comprises:

(a) a first crank including a horizontally extending portion having a first end and a second end, an upper arm having an upper end and a lower end, said lower end of said upper arm being integrally attached to said first end of said horizontally extending portion of said first crank with said upper arm of said first crank upstanding from said horizontally extending portion of said first crank, and a lower arm of said first crank having an upper end and a lower end, said upper end of said lower arm being integrally attached to said second end of said horizontally extending portion of said first crank with said lower arm depending from said horizontally extending portion of said first crank; and (b) first socket means attached to said first table top half and removably receiving said upper end of said upper arm of said first crank for rotation of said table about said upper arm of said first crank.

6. The combination of claim 5 in which said second crank means comprises:

(a) a second crank including a horizontally extending portion having a first end and a second end, an upper arm having an upper end and a lower end, said lower end of said upper arm being integrally attached to said first end of said horizontally extending portion of said second crank with said upper arm of said second crank upstanding from said horizontally extending portion of said second crank, and a lower arm of said second crank having an upper end and a lower end, said upper end of said lower arm of said second crank being integrally attached to said second end of said horizontally extending portion of said second crank with said lower arm of said second crank depending from said horizontally extending portion of said second crank; and (b) second socket means attached to said second table half and removably receiving said upper end of said upper arm of said second crank for rotation of said table about said upper arm of said second crank.

7. The combination of claim 6 in which said first attachment means comprises:

(a) a first mounting tube having an upper end and a lower end, said first mounting tube rotatably receiving said lower arm of said first crank, (b) first bracket means for attachment to said first portion of said frame, said first bracket means including spaced first tab means for removably receiving said first mounting tube therebetween to selectively hold said first mounting tube in a vertical position, and (c) first pivot means for pivotally mounting said first mounting tube on said first bracket means.

8. The combination of claim 7 in which said second attachment means comprises:

(a) a second mounting tube having an upper end and a lower end, said second mounting tube rotatably receiving said lower arm of said second crank, (b) second bracket means for attachment to said second portion of said frame, said second bracket means including spaced second tab means for removably receiving said second mounting tube therebetween to selectively hold said second mounting tube in a vertical position, and (c) second pivot means for pivotally mounting said second mounting tube on said second bracket means.

* * * * *